US008382220B2

(12) United States Patent
Kim

(10) Patent No.: US 8,382,220 B2
(45) Date of Patent: Feb. 26, 2013

(54) DECORATIVE PANEL AND REFRIGERATOR HAVING THE SAME

(75) Inventor: Ung-Su Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 205 days.

(21) Appl. No.: 12/777,284

(22) Filed: May 11, 2010

(65) Prior Publication Data

US 2010/0295425 A1 Nov. 25, 2010

(30) Foreign Application Priority Data

May 22, 2009 (KR) ..... 10-2009-0045147

(51) Int. Cl.
*A47B 96/00* (2006.01)

(52) U.S. Cl. ..... 312/405; 312/223.5; 40/219; 362/92; 362/94

(58) Field of Classification Search ..... 312/204, 312/223.5, 348.4, 401, 405; 362/92, 94, 362/605, 565; 40/219, 442, 443
See application file for complete search history.

(56) References Cited

U.S. PATENT DOCUMENTS 3,773,399 A * 11/1973 Sulcek ..... 312/204
5,520,453 A * 5/1996 Aoki et al. ..... 312/406
5,584,547 A * 12/1996 Trulaske, Sr. ..... 312/223.5
5,657,563 A * 8/1997 Lane ..... 40/219
5,787,618 A * 8/1998 Mullis ..... 40/219
6,056,383 A * 5/2000 Banicevic et al. ..... 312/406
6,935,712 B2 * 8/2005 Reed et al. ..... 312/405
7,029,152 B1 * 4/2006 Kuhl ..... 362/489
7,059,693 B2 * 6/2006 Park ..... 312/405.1
7,347,608 B2 * 3/2008 Emde ..... 362/604
2002/0159741 A1 * 10/2002 Graves et al. ..... 385/133
2004/0222725 A1 * 11/2004 Park et al. ..... 312/405
2005/0225221 A1 * 10/2005 Song et al. ..... 312/401
2006/0082221 A1 * 4/2006 Mouzas ..... 307/10.1
2006/0137378 A1 * 6/2006 Choi ..... 62/264
2006/0260155 A1 * 11/2006 Molleda Leon ..... 40/219
2008/0042537 A1 * 2/2008 Kim et al. ..... 312/405
2008/0066355 A1 * 3/2008 Misawa et al. ..... 40/541
2008/0088212 A1 * 4/2008 Annas ..... 312/203
2008/0143227 A1 * 6/2008 Kim et al. ..... 312/405
2009/0244884 A1 * 10/2009 Trulaske, Sr. ..... 362/94

* cited by examiner

*Primary Examiner* — James O Hansen
*Assistant Examiner* — Matthew Ing
(74) *Attorney, Agent, or Firm* — Fish & Richardson P.C.

(57) ABSTRACT

A decorative panel and a refrigerator having the same are presented. Inner gorgeous decorative patterns are seen according to an opening and closing operation of a refrigerator door usually serving as a mirror, providing the user a continuous aesthetic sense with which the user is not bored compared with decorative patterns which are always exposed. In addition, a mirror face is formed on a front plate and a decorative plate to continuously reflect the decorative patterns to thereby provide a three-dimensional aesthetic sense with the planar decorative patterns. Also, because recesses or protrusions are formed on the decorative plate to obtain a decorative effect, the usage amount of high-priced components such as jewels can be reduced to lower a fabrication cost of a product.

5 Claims, 6 Drawing Sheets

DECORATIVE PANEL AND REFRIGERATOR HAVING THE SAME

The present application claims priority to Korean Application No. 10-2009-0045147 filed in Korea on May 22, 2009, the entire contents of which is hereby incorporated by reference in its entirety.

BACKGROUND OF THE INVENTION

1. Field of the Invention

The present invention relates to a decorative panel and a refrigerator having the same and, more particularly, to a decorative panel having a perspective of a decorative pattern to enhance an aesthetic sense and incurring a low material cost, and a refrigerator having the same.

2. Description of the Related Art

In general, a refrigerator is a device having a certain accommodating space to keep food items, or the like, in a low temperature state. Discriminating low temperature ranges for freezing or refrigerating food items depending on the state of food items to be kept in storage, the refrigerator is divided into a freezing chamber for keeping food items in storage in a below-zero degree and a refrigerating chamber for keeping food items in storage in an above-zero degree. Cooling air is continuously supplied to the interior of the refrigerator, and cooling air is continuously generated by a heat exchanging operation of a refrigerant which repeatedly performs the cycle of compressing, condensing, expanding, and evaporating.

The refrigerator includes a type in which the freezing chamber is positioned at an upper side of the refrigerating chamber, a type in which the freezing chamber is positioned at a lower side of the refrigerating chamber, and a type in which the freezing chamber and the refrigerating chamber are positioned to be adjacent horizontally.

Recently, refrigerators increase in size and multifunctional in line with the diversification of user preferences and a change in the people's dietary life. Also, refrigerators have various decorative patterns on their outer appearance, enhancing aesthetical sense. According to the trend, refrigerators having jewels or paintings of famous artists as ornamentation are being introduced.

However, in spite of the various decorative patterns applied to the related art refrigerators, they have no change in the decorative patterns or are flat or two-dimensional, so if those refrigerators are in use for a long period of time, users may be easily bored with them.

In addition, when jewel is used as decorative patterns, much cost incurs compared with its effect, increasing the fabrication cost.

SUMMARY OF THE INVENTION

Therefore, in order to address the above matters, the various features described herein have been conceived.

An aspect of the present invention provides a decorative panel capable of making decorative patterns change to allow the user to enjoy an aesthetic sense without getting bored with for a long period of time, and a refrigerator having the same.

Another aspect of the present invention provides a decorative panel capable of reducing a material cost required for forming decorative patterns to thereby obtaining the same decorative effect at a relatively low fabrication cost, and a refrigerator having the same.

According to an aspect of the present invention, there is provided a decorative panel including: a translucent glass plate having a first mirror face serving as a mirror or glass according to a brightness difference between both sides; a decorative plate disposed at one side of the translucent glass plate and having decorative patterns; and an illumination unit supplying illumination to the decorative patterns to allow the decorative patterns to be seen from an outer side of the translucent glass plate, wherein the illumination unit includes a light emission unit emitting light, and a switching unit electrically connected with the light emission unit and turning on and off the light emission unit.

According to another aspect of the present invention, there is provided a refrigerator including: a door for opening and closing a freezing chamber or a refrigerating chamber; a translucent glass plate installed on a front surface of the door and having a first mirror face serving as a mirror or glass according to a brightness difference between both sides; a decorative plate installed on the front surface of the door so as to be disposed at one side of the translucent glass plate and having certain decorative patterns; and an illumination unit supplying illumination to the decorative patterns to allow the decorative patterns to be seen from an outer side of the translucent glass plate, wherein the illumination unit includes a light emission unit emitting light, and a switching unit electrically connected with the light emission unit and turning on and off the light emission unit.

The foregoing and other objects, features, aspects and advantages of the present invention will become more apparent from the following detailed description of the present invention when taken in conjunction with the accompanying drawings.

DETAILED DESCRIPTION OF THE INVENTION

A decorative panel and a refrigerator having the same according to exemplary embodiments of the present invention will now be described with reference to the accompanying drawings.

Figure 1:
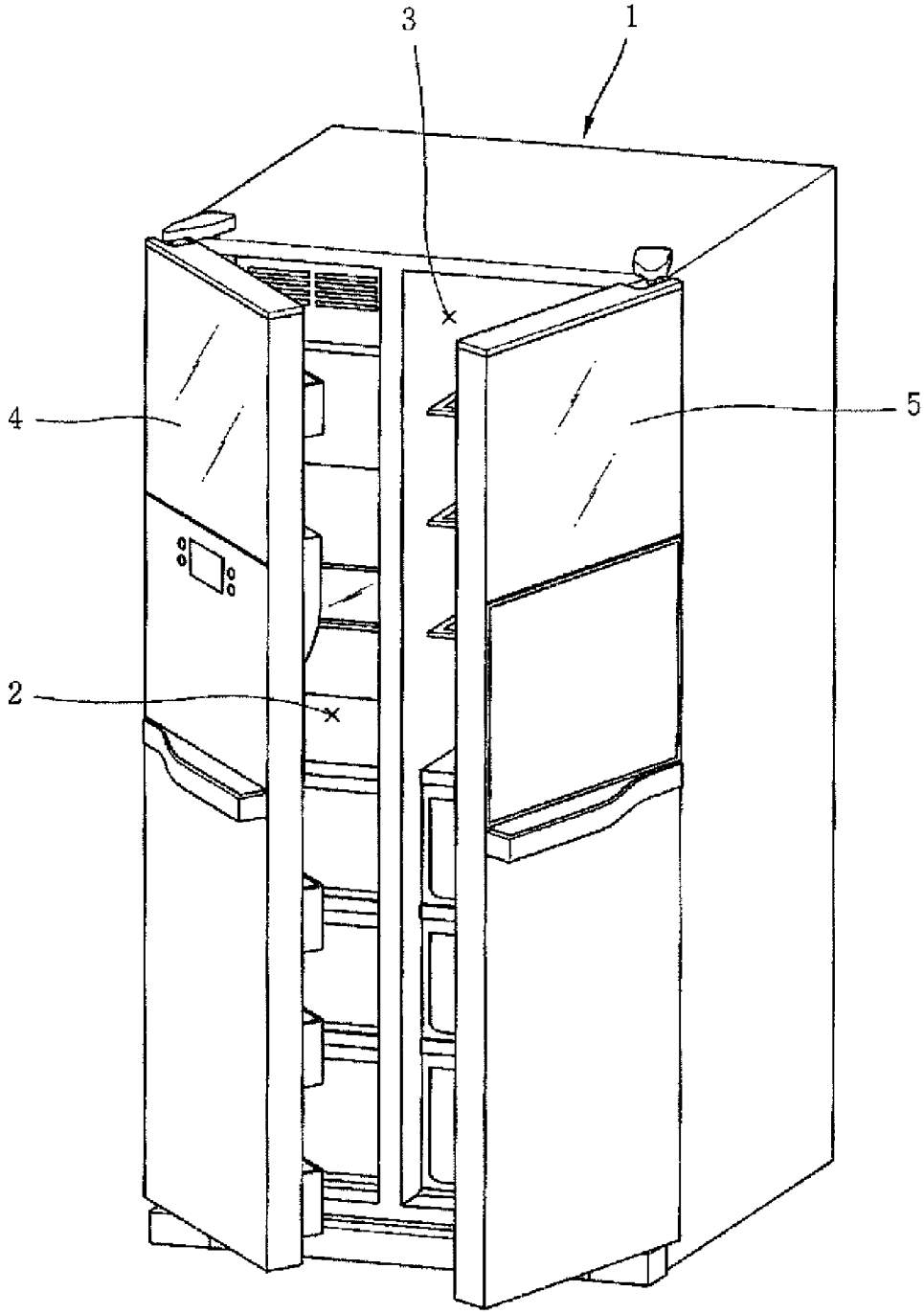
FIG. 1 is a perspective view of a side-by-side type refrigerator having a decorative panel according to an exemplary embodiment of the present invention.
Figure 2:
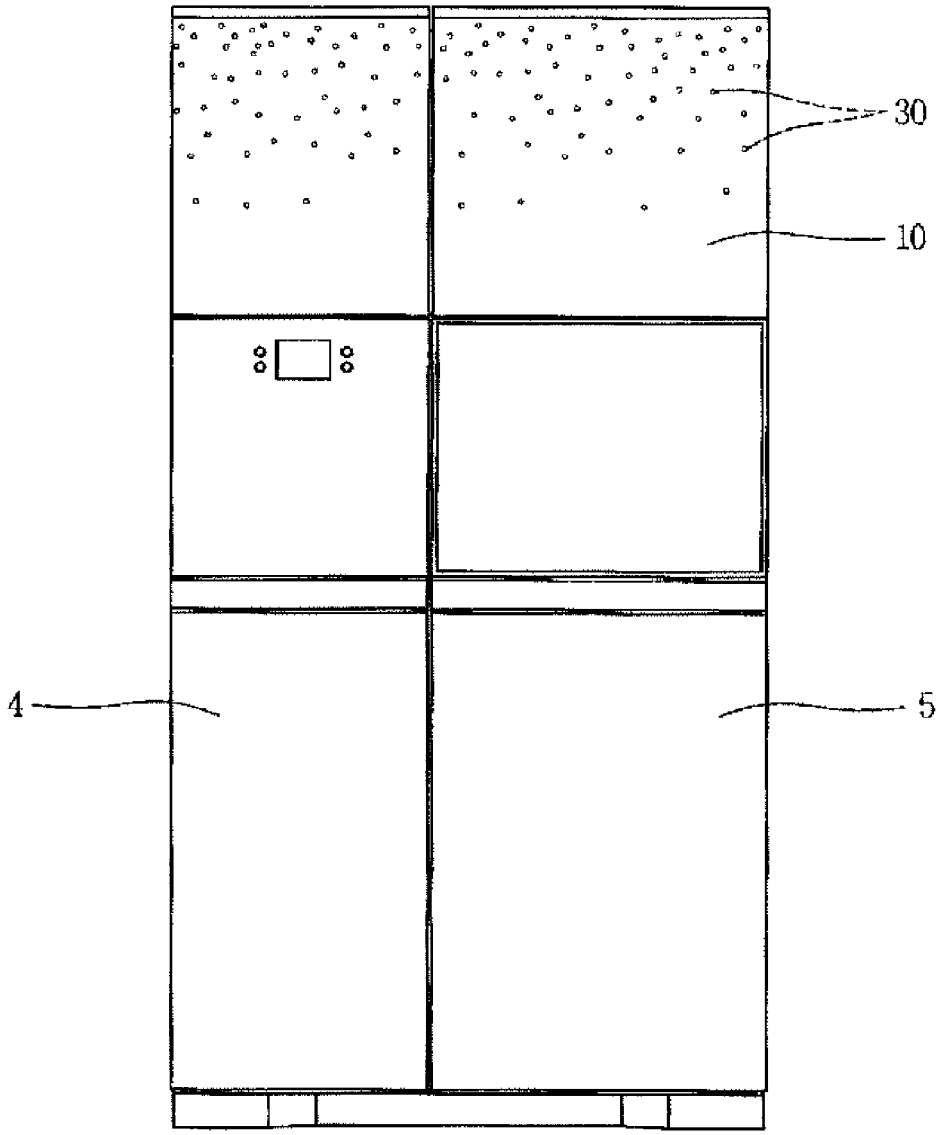
FIG. 2 is a front view of the side-by-side type refrigerator of FIG. 1.
Figure 3:
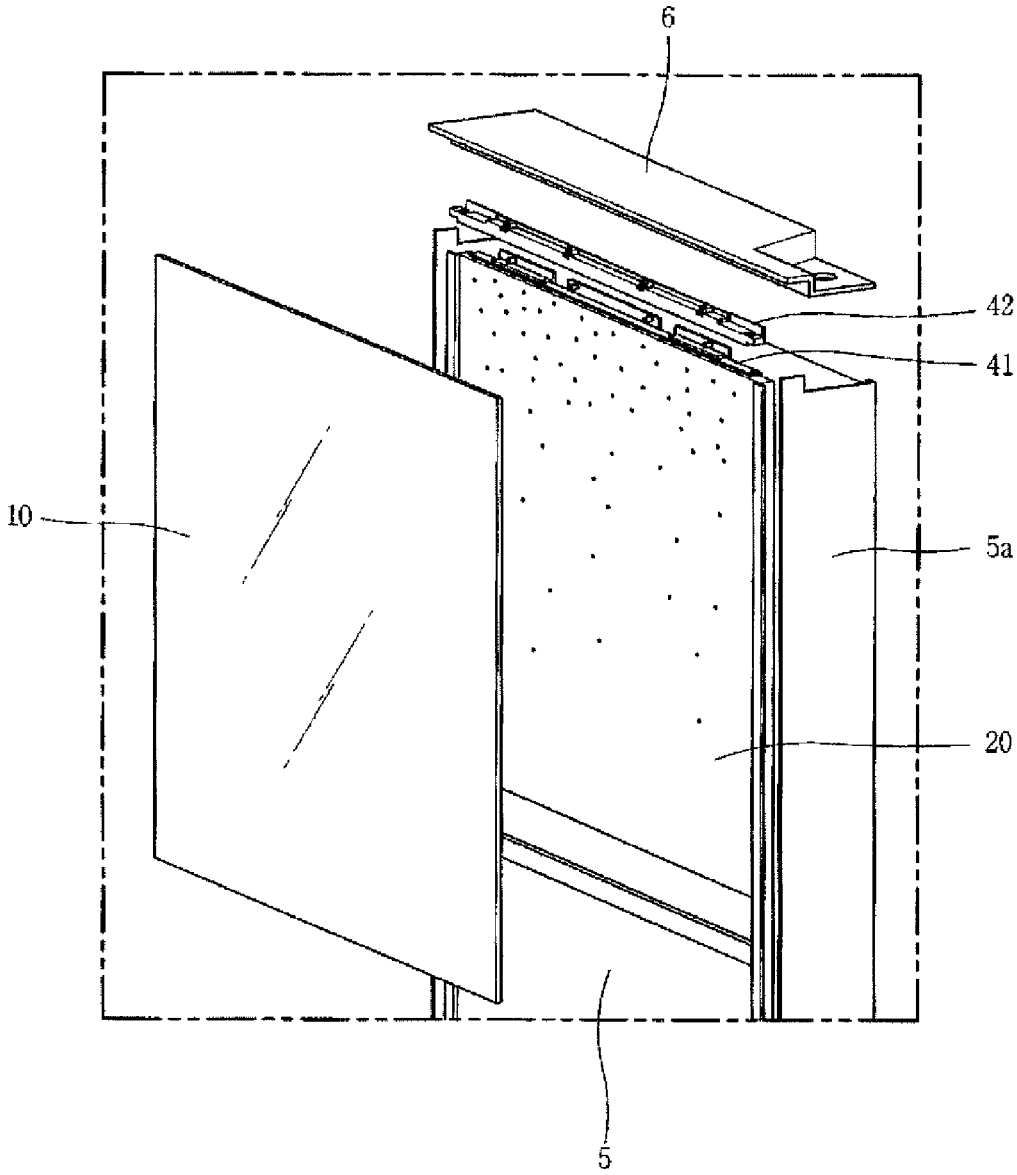
FIG. 3 is a perspective view showing a front plate separated from the door of the refrigerator of FIG. 1.
Figure 4:
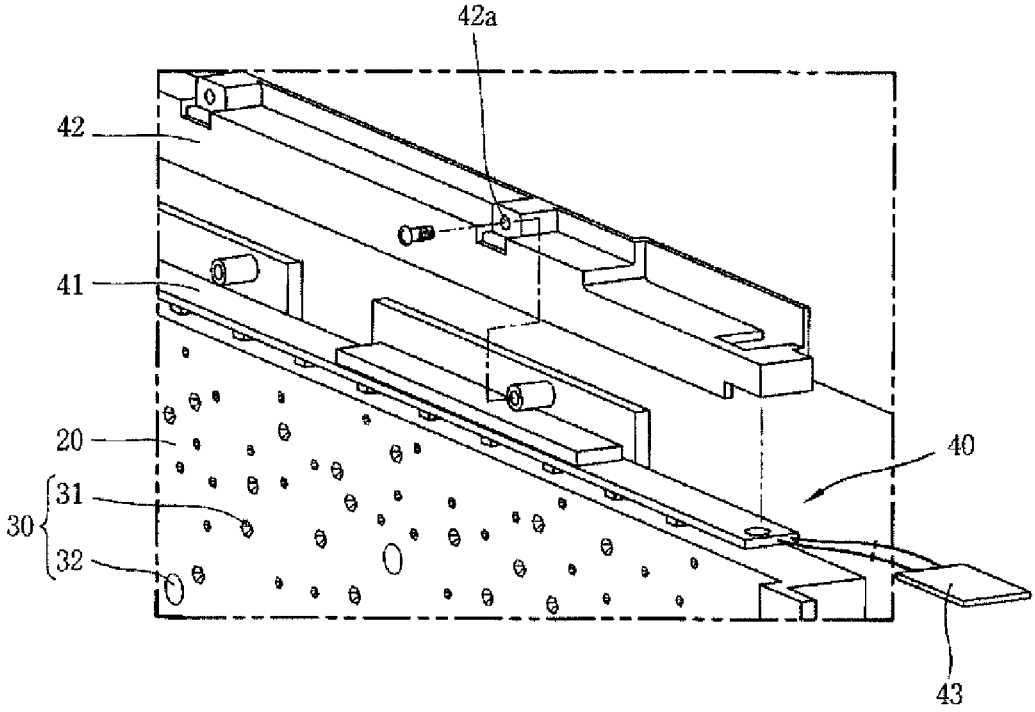
FIG. 4 is a perspective view showing a separated cover of a light emission unit in FIG. 3.
Figure 5:
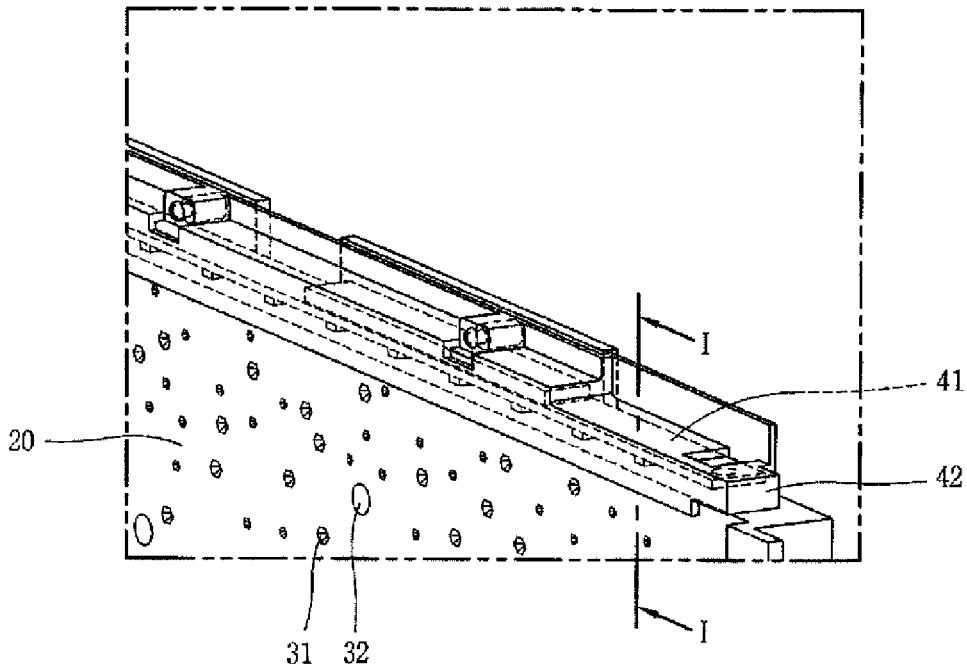
FIG. 5 is a perspective view showing an assembled cover of the light emission unit in FIG. 4.

FIG. 1 is a perspective view of a side-by-side type refrigerator having a decorative panel according to an exemplary embodiment of the present invention, and FIG. 2 is a front view of the side-by-side type refrigerator of FIG. 1.

As shown in FIGS. 1 and 2, the refrigerator according to an exemplary embodiment of the present invention includes a freezing chamber 2 for freezing and keeping food items in storage and refrigerating and keeping food items in storage at both of left and right sides of a refrigerator main body 1, respectively. A freezing chamber door 5 and a refrigerating chamber door 4 are installed at both ends of the left and right sides of the refrigerator main body 1 and open and closed in a hinged-door manner.

A mechanic chamber (not shown) is formed at a lower end of a rear side of the refrigerator body 1, in which a compressor and a condenser are installed.

An evaporator (not shown) connected with the condenser and the compressor to supply cooling air to the freezing chamber 2 or to the refrigerating chamber 3 may be installed on the rear surface of the refrigerator body 1, namely, on the rear wall surface of the freezing chamber 2, may be insertedly installed at an inner side of a wall surface or an upper wall surface of the freezing chamber 2, or may be insertedly positioned at an inner side of a barrier demarcating the freezing chamber 2 and the refrigerating chamber 3.

A single evaporator may be installed at the freezing chamber 2 to distributedly supply cooling air to the freezing chamber 2 and to the refrigerating chamber. Alternatively, a freezing chamber evaporator and a refrigerating chamber evaporator may be installed separately in order to independently supply cooling air to the freezing chamber 2 and to the refrigerating chamber 3.

The refrigerator door of the refrigerator according to an exemplary embodiment of the present invention is hinge-coupled with the refrigerator body to open or close the freezing chamber or the refrigerating chamber of the refrigerator body. In addition, in many cases, various decorative patterns are formed on a front surface of the refrigerator door to obtain an elegant appearance to enhance an aesthetic sense of the produce. Hereinafter, a refrigerator with a decorative panel applied to a refrigerator door will now be described.

As shown in FIGS. 2 to 5, the refrigerator door 5 includes a front plate 10 formed on its front surface. The front plate 10 may be configured as a glass plate or an iron plate. In the exemplary embodiment of the present invention, the decorative pattern of the decorative plate 20 (to be described) should be seen from the exterior of the front plate 10, so the front plate 10 is preferably formed as a translucent glass plate (or reflecting glass plate). The front plate 10 includes a first mirror face 12 formed by coating chromium or the like on an inner surface of the first glass face 11 corresponding to the decorative plate 20 (to be described) in order to serve as a mirror or glass according to the brightness at the inner side.

The decorative plate 20 is installed at an inner side of the front plate 10, namely, at the side facing the outer case 5*a* of the refrigerating chamber door 5, such that it faces the inner side of the front plate 10. The decorative plate 20 may be made of a material of engineering plastic with high strength and good light transmission such as polycarbonate. Decorative patterns 20

A plurality of decorative patterns 30 including individual decorations 31 such as gems may be installed on one side of the decorative plate 20, namely, on the inner surface of the decorative plate 20 corresponding to the front plate 10.

Figure 6:
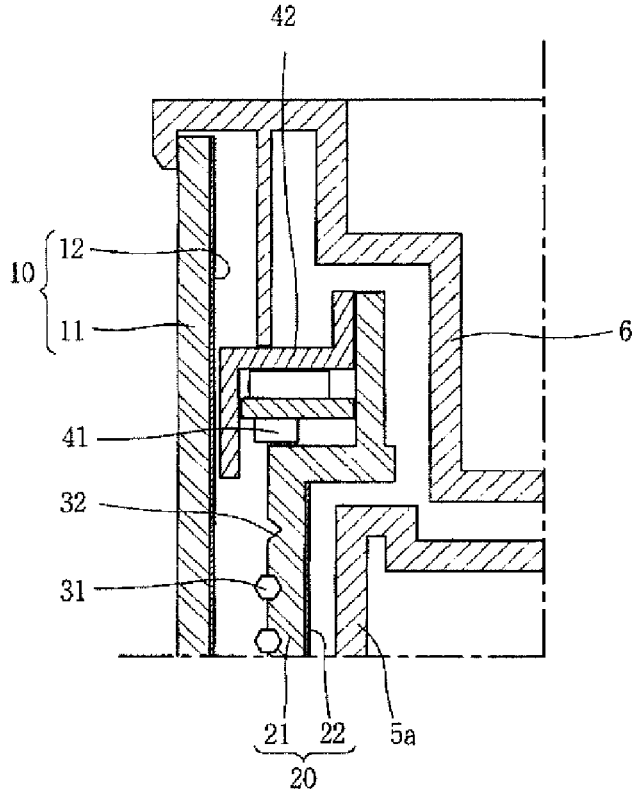
FIG. 6 is a sectional view taken along line I-I in FIG. 5.

The individual decorations 31 may be installed as many as possible to enhance a decorative effect at the outer side. However, because the individual decorations 31 are high-priced, installation of a large amount of decorations would possibly increase the material cost of the refrigerator. Thus, a plurality of decorative recesses (or decoration protrusions) 32, which may be used in place of the germs, may be formed on the decorative plate 20. As shown in FIG. 6, the decorative recesses 32 may be formed with a certain depth on a second glass surface 21 forming an inner side surface of the decorative plate 20, and may have an angular polyhedral shape like germs to further enhance the decorative effect.

A second mirror face 22 may be formed by coating chromium or the like on the other side surface of the decorative plate 20, namely, on the outer side surface facing the outer case 5*a* as shown in FIG. 6. The second mirror face 22 may be also formed on the inner side surface of the decorative plate 20, namely, on the inner side surface of the second glass surface 21. In this case, however, there is a limitation in a multi-layer reflection of the decorative pattern 30 installed or formed on the decorative plate 20. Thus, preferably, the second mirror face 22 is formed on the outer side surface of the decorative plate 20.

As shown in FIGS. 3 to 6, a light emitting unit 41, namely, an LED of an illumination unit 40 is installed on an upper end face of the decorative plate 20 in order to provide illumination to the decorative plate 20. The light emitting unit 41 is formed to be lengthy so as to have the substantially same length as the length of the upper surface of the decorative plate 20. Of course, the light emitting unit 41 may be also installed at the side face or at a lower end face of the decorative plate 20, but in order to enhance an aesthetic sense like the Milky Way, the light emitting unit 41 is preferably installed at the upper end face of the decorative plate 20.

The light emitting unit 41 may be fixedly fastened to the decorative plate 20 or to the outer case 5*a* of the refrigerating chamber door 5. In this case, however, the light emitting unit 41 may be possibly damaged during the fastening process, so it may be preferably fixed by using a light emitting unit cover 42.

The light emitting unit cover 42 may be formed to be lengthy so as to cover at least one side, namely, the rear side surface or the upper side surface of the light emitting unit 41, and a fastening hole 42*a* may be formed at the center of the light emitting unit cover 42 such that it can be fastened to the decorative plate 20. Although not shown, the light emitting unit cover 42 may be fastened to the refrigerator door.

The light emitting unit 41 may flicker by cooperatively operating with the opening and closing operation of the refrigerating chamber door 5, namely, by interworking with the overall controlling of the refrigerator.

To this end, the light emitting unit 41 may be electrically connected with the switching unit 43 that selectively turns on and off the light emitting unit 41. One end of the switching unit 43 is electrically connected with the light emitting unit 41, and the other end of the switching unit 43 may be electrically connected with a main board (not shown) of the refrigerator that determines the opening and closing operation of the refrigerating chamber door 5 to control the ON/OFF operation of an illumination unit of the refrigerator.

Then, when the refrigerating chamber door 5 is open, the switching unit 43 is turned on together with the illumination unit of the refrigerating chamber 3 to make the light emitting unit 41 emit light, and when the refrigerating chamber door 5 is closed, the switching unit 43 may be turned off together with the illumination unit of the refrigerating chamber 3 to turn off the light emitting unit 41. Of course, the light emitting unit 41 may be switched such that it interworks in the opposite way to the illumination of the refrigerating chamber.

Reference numeral 6 denotes a deco cap covering the edges of the refrigerating chamber door.

The refrigerator according to an exemplary embodiment of the present invention has the following operational effect.

Figure 7:
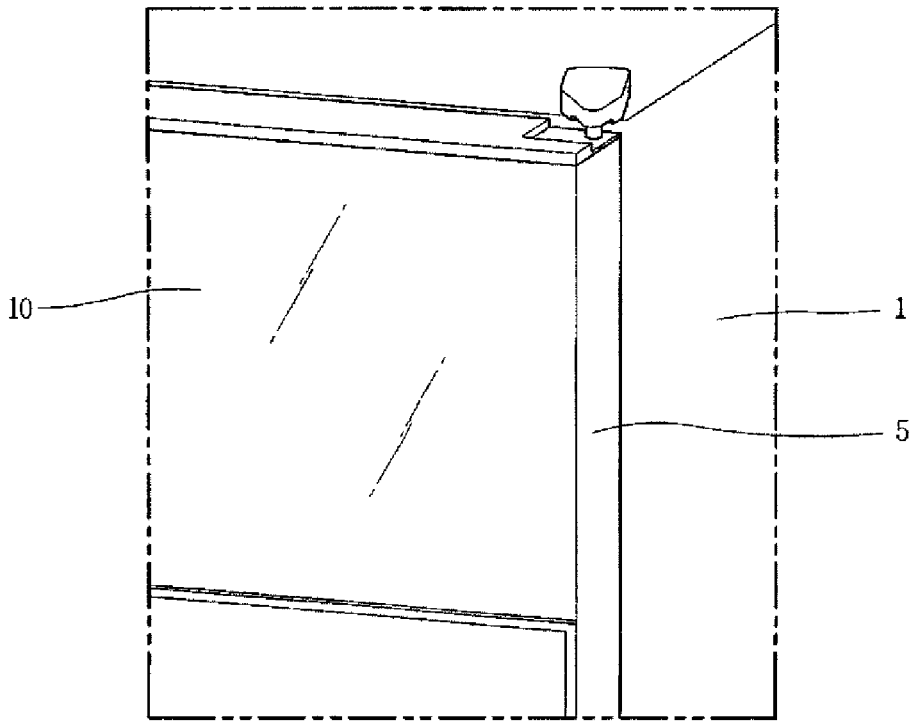
FIG. 7 is a front view showing a state of a mirror of the decorative panel of the side-by-side type refrigerator having the decorative panel in FIG. 1.

That is, as shown in FIG. 7, when the refrigerating chamber door 5 is closed, the light emitting unit 41 of the illumination unit 40 is maintained in an turned-off state. Then, the interior of the front plate 10 is so dark that the decorative pattern 30 provided on the decorative plate 20 cannot be seen from outside. Namely, the front plate 10 does not serve as glass but serves only as a mirror. Accordingly, the user cannot view the decorative pattern 30 provided at the inner side of the front plate 10 of the refrigerating chamber door 5.

Figure 8:
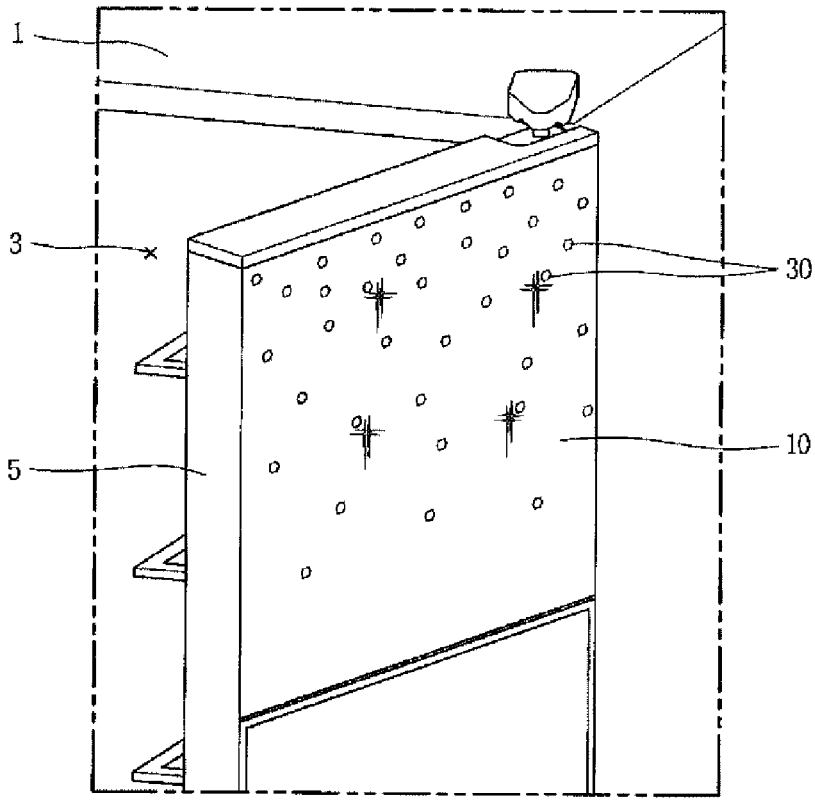
FIG. 8 is a front view showing a state of glass of the decorative panel of the side-by-side type refrigerator having the decorative panel in FIG. 1.

Meanwhile, as shown in FIG. 8, when the user opens the refrigerating chamber door 5 in order to taken a food item out of the refrigerating chamber 3, the switching unit 43 of the illumination unit 40 interworks to make the light emitting unit 41, namely, the LED, emit light at the same time when the refrigerating chamber door 5 is open. Then, the inner side of the front plate 10 is bright to allow the decorative pattern 30 of the decorative plate 20 to be mirrored to outside. Namely, the front plate 10 serves as glass. Then, the user or people around the user can view the inner decorative pattern 30 through the front plate 10.

Figure 9:
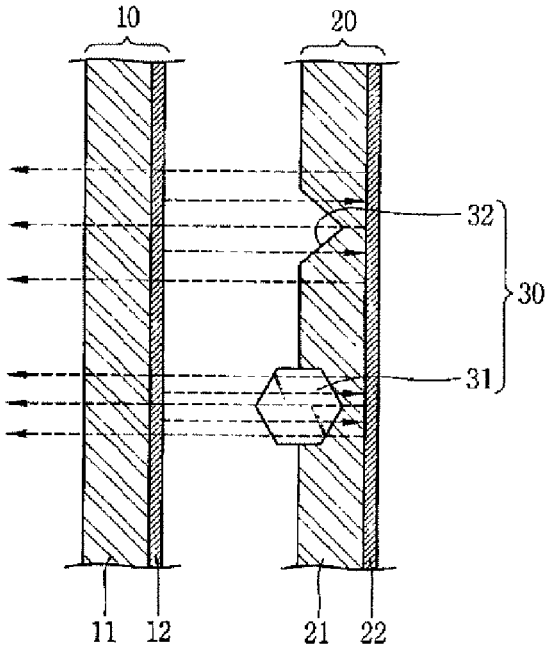
FIG. 9 is a schematic view for explaining the principle based on which the decorative patterns of the decorative panel in FIG. 8 are seen at an outer side.

In this case, as shown in FIG. 9, a first mirror face 12 and a second mirror face 22 are provided on the rear surface of the front plate 10 and on the rear surface of the decorative plate 20, whereby the decorative pattern 30 of the decorative plate 20 can be continuously reflected by the first and second mirror faces 12 and 22 so as to be recognized as an infinitely deep, namely, as a three-dimensional decorative pattern.

In this manner, because the gorgeous decorative pattern provided at the inner side is exposed to be seen suddenly when the refrigerating chamber door usually serving as a mirror is open, a continuous aesthetic sense can be provided to the user, which is not boresome compared with the case where a decorative pattern is always exposed to be seen.

In addition, because the mirror faces are formed on the front plate and the decorative plate to continuously reflect the decorative pattern, the cubical (three-dimensional) aesthetic sense can be provided by using the flat (one-dimensional) decorative pattern, enhancing the user satisfaction.

Also, because the recesses or protrusions are formed on the decorative plate to exhibit a decorative effect, the usage amount of high-priced components such as germs can be reduced, and thus, the fabrication unit cost as much can be reduced.

The refrigerating chamber door has been taken as an example in the description of the exemplary embodiment of the present invention, but the present invention can be also applicable to the freezing chamber door in the same manner.

Also, in the above description, the decorative panel and the refrigerator having the same according to an exemplary embodiment of the present invention are applied to the two way refrigerator, but they can be also applicable to any kind of refrigerator in the same manner.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator comprising:

a door for opening and closing a freezing chamber or a refrigerating chamber;

a translucent glass plate installed on a front surface of the door and having a first mirror face serving as a mirror or glass according to a brightness difference between both sides;

a decorative plate installed on the front surface of the door so as to be disposed at one side of the translucent glass plate and having certain decorative patterns;

a light emission unit mounted on an upper surface of the decorative plate, the light emission unit being configured to emit light to the decorative patterns to allow the decorative patterns to be seen from an outer side of the translucent glass plate;

a cover coupled to the decorative plate and configured to support the light emission unit; and a deco cap coupled to an upper end of the refrigerator door and configured to receive the cover therein, wherein the cover comprises:

a first supporting portion coupled to the decorative plate, a second supporting portion bent from one end of the first supporting portion and configured to press an upper surface of the light emission unit such that the light emission unit is positioned between an upper surface of the decorative plate and a lower surface of the second supporting portion, and a third supporting portion bent from one end of the second supporting portion and configured to support a front side surface of the light emission unit, wherein the decorative plate further comprises a fixing portion extending from the upper surface of the decorative plate and configured to support a rear side surface of the light emission unit.

2. The refrigerator of claim 1, wherein the fixing portion of the decorative plate includes a fastener receiving portion, and wherein the first supporting portion of the cover comprises a fastening hole configured to couple to the fastener receiving portion of the decorative plate via a fastener.

3. The refrigerator of claim 1, wherein the deco cap comprises a downward extending portion configured to pressingly support the second supporting portion of the cover.

4. The refrigerator of claim 1, further comprising a switching unit electrically connected with the light emission unit and configured to control the light emission unit, the switching unit being configured to turn the light emission unit on and off cooperatively according to an opening and closing operation of the door.

5. The refrigerator of claim 1, wherein the decorative plate is made of a light-transmissive material or a transparent material, decorative patterns are formed on a first surface of the decorative plate that faces the mirror face of the translucent glass plate, and a second mirror face forming a reflective face with respect to the first mirror face of the translucent glass plate is formed on a second face of the decorative plate, the opposite face of the first face of the decorative plate.

* * * * *